US010443843B2

(12) United States Patent
Ho

(10) Patent No.: US 10,443,843 B2
(45) Date of Patent: Oct. 15, 2019

(54) SAFETY DEVICE FOR GAS BURNER

(71) Applicant: REKROW INDUSTRIAL INC., New Taipei (TW)

(72) Inventor: Ta-Jen Ho, New Taipei (TW)

(73) Assignee: Rekrow Industrial Inc., New Taipei (TW)

( * ) Notice: Subject to any disclaimer, the term of this patent is extended or adjusted under 35 U.S.C. 154(b) by 154 days.

(21) Appl. No.: 15/712,355

(22) Filed: Sep. 22, 2017

(65) Prior Publication Data

US 2019/0093889 A1 Mar. 28, 2019

(51) Int. Cl.

| | |
|---|---|
| ***F23D 11/36*** | (2006.01) |
| ***F23Q 2/16*** | (2006.01) |
| ***F23D 14/38*** | (2006.01) |
| ***F23D 14/46*** | (2006.01) |
| ***F23D 14/72*** | (2006.01) |

(52) U.S. Cl.

CPC ..... *F23Q 2/164* (2013.01); *F23D 14/38* (2013.01); *F23D 14/465* (2013.01); *F23D 14/72* (2013.01)

(58) Field of Classification Search

CPC ..... F23Q 2/164; F23D 14/38; F23D 14/465; F23D 2207/00; F23D 14/28; F23D 14/72

See application file for complete search history.

(56) References Cited

U.S. PATENT DOCUMENTS 6,065,959 A * 5/2000 Tsai ..... F23D 14/28 126/406
2002/0076667 A1* 6/2002 Man ..... F23Q 2/164 431/142

FOREIGN PATENT DOCUMENTS

EP 0551654 A2 * 7/1993 ..... F23Q 2/164

* cited by examiner

*Primary Examiner* — Jason Lau
(74) *Attorney, Agent, or Firm* — Rosenberg, Klein & Lee

(57) ABSTRACT

A safety device for a gas burner includes an ignition-gas unit and a lever is pivotably connected to the installation port. The lever extends beyond a cover on the ignition-gas unit and includes a free end to which a restriction member and a spring are connected. The spring drives the restriction member toward the cover to restrict the lever from being pushed to ignite the gas burner. When the restriction member is moved, the user can push the free end downward to activate the ignition-gas unit to ignite the gas burner.

7 Claims, 9 Drawing Sheets

SAFETY DEVICE FOR GAS BURNER

BACKGROUND OF THE INVENTION

1. Fields of the Invention

The present invention relates to a safety device for a gas burner, and the gas burner can be operated by one-time action.

2. Descriptions of Related Art

The operation of a conventional gas burner is to press the ignition button and then rotates a collar to adjust the gas and the flame. This conventional way of option is easy, however, the ignition button may be pressed unexpectedly or touched by kids to cause injury.

One of the safety devices for the gas burners includes an ignition button and a safety button which is located separated from the ignition button. In other words, when operating the gas burner, the user has to press the safety button first, and then press the ignition button. The ignition button is located at a frame, and the safety button is located in a slot, this arrangement requires a longer time for installation.

The present invention intends to provide a safety device for a gas burner, wherein the ignition action and the safety feature are operated within one time action.

SUMMARY OF THE INVENTION

The present invention relates to a safety device for a gas burner, the gas burner includes a gas tube and a nozzle connected to the gas tube. The safety device comprises an ignition-gas unit connected to the nozzle. A cover is mounted to the ignition-gas unit and includes a stop on the outside thereof, a hole and an installation port. The installation port faces downward. The hole is located beside the stop and communicates with the installation port. The ignition-gas unit is accommodated in the installation port. A lever includes a pivotal portion, a free end and a touch portion which is located between the pivotal portion and the free end. The touch portion is located corresponding to the ignition-gas unit. The pivotal portion is pivotably connected to the installation port, and the free end extends beyond the hole.

A restriction member includes an activation portion and a hook portion respectively located on two ends thereof. The activation portion is located at the free end of the lever. The hook portion faces the stop. A spring is located between the free end of the lever and the activation member of the restriction member so as to provide a force to allow the restriction member to move relative to the free end of the lever. The spring maintains the restriction member to contact the hook portion against the stop so as to restrict the free end from being pushed downward. When the restriction member drives the spring to move the hook portion to move away from the free end of the lever, the free end is able to be pushed downward and the touch portion presses the ignition-gas unit.

Preferably, the cover includes a restriction slot located beside the stop. When the free end is pushed downward and the touch portion presses the ignition-gas unit, the activation portion is rotated to hook the hook portion with the restriction slot.

Preferably, the free end of the lever includes two lugs and a pivot, wherein the two lugs extend from the activation portion, and the pivot extends through the two lugs and the activation portion.

Preferably, each of the two lugs and the activation portion includes a passage through which the pivot extends. The activation portion includes a toothed portion defined in the outside thereof.

Preferably, one of the two lugs of the lever has a recess. The activation portion has a protrusion which is movably located within the recess to restrict pivotal movement of the activation portion.

Preferably, the other one of the two lugs has a first slot. The activation portion has a second slot. The spring is a torsion spring which includes two distal ends which are respectively engaged with the first and second slots so as to drive the restriction member relative to the lever.

Preferably, a board is located between the activation portion and the hook portion. An angle less than 90 degrees is formed between the board and the hook portion.

Preferably, the spring is a compression spring, two ends of the spring are respectively connected to the free end of the lever and the activation portion of the restriction member. The spring normally pulls the restriction member toward the cover and the hook portion contacts the stop, so that the free end of the lever cannot be pushed downward. When the restriction member pulls the spring in a direction away from the free end linearly, the hook portion is disengaged from the stop, so that the free end of the lever is able to be pushed downward, and the touch portion pushes the ignition-gas unit.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
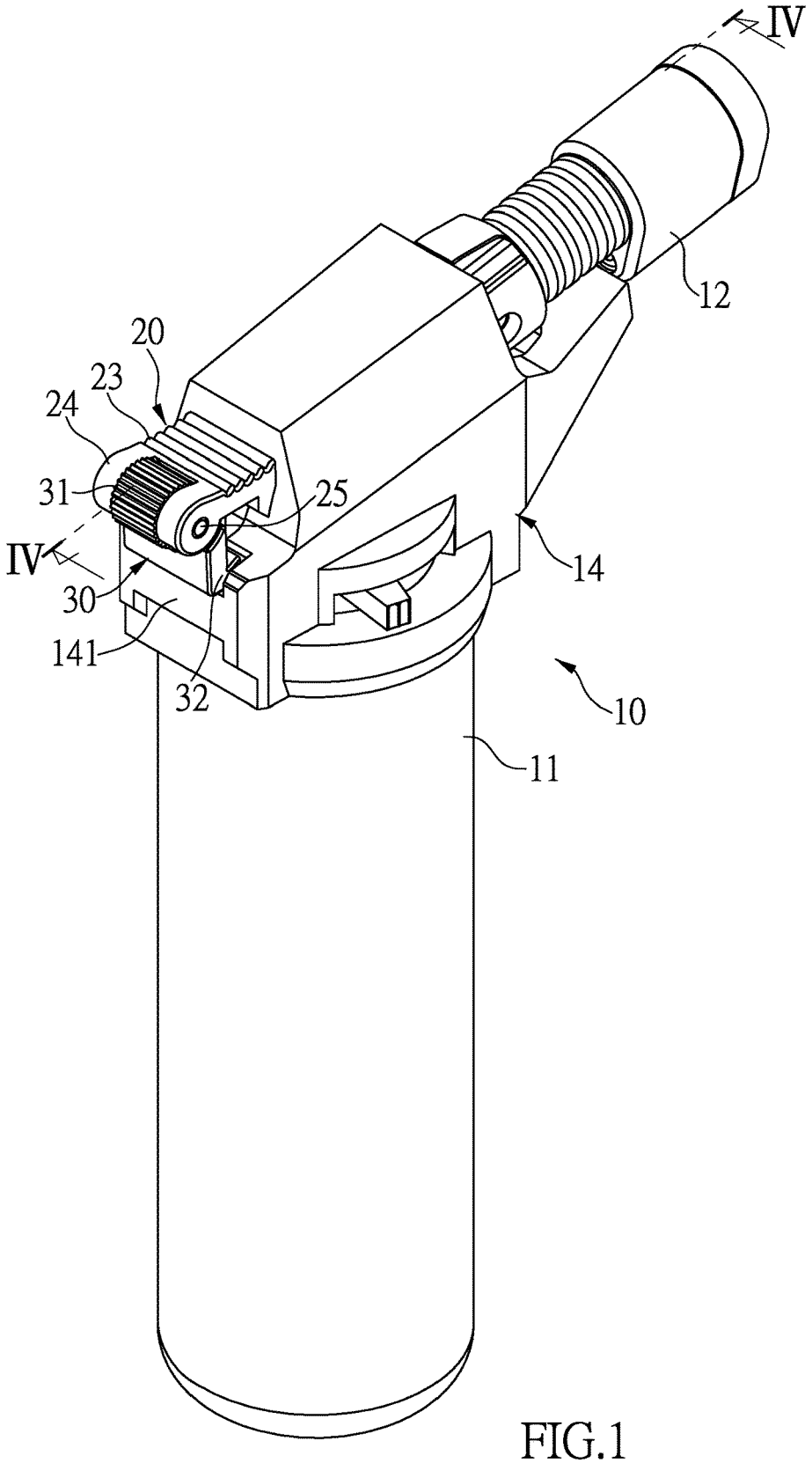
FIG. 1 is a perspective view to show the safety device of the present invention is installed to a gas tube.
Figure 2:
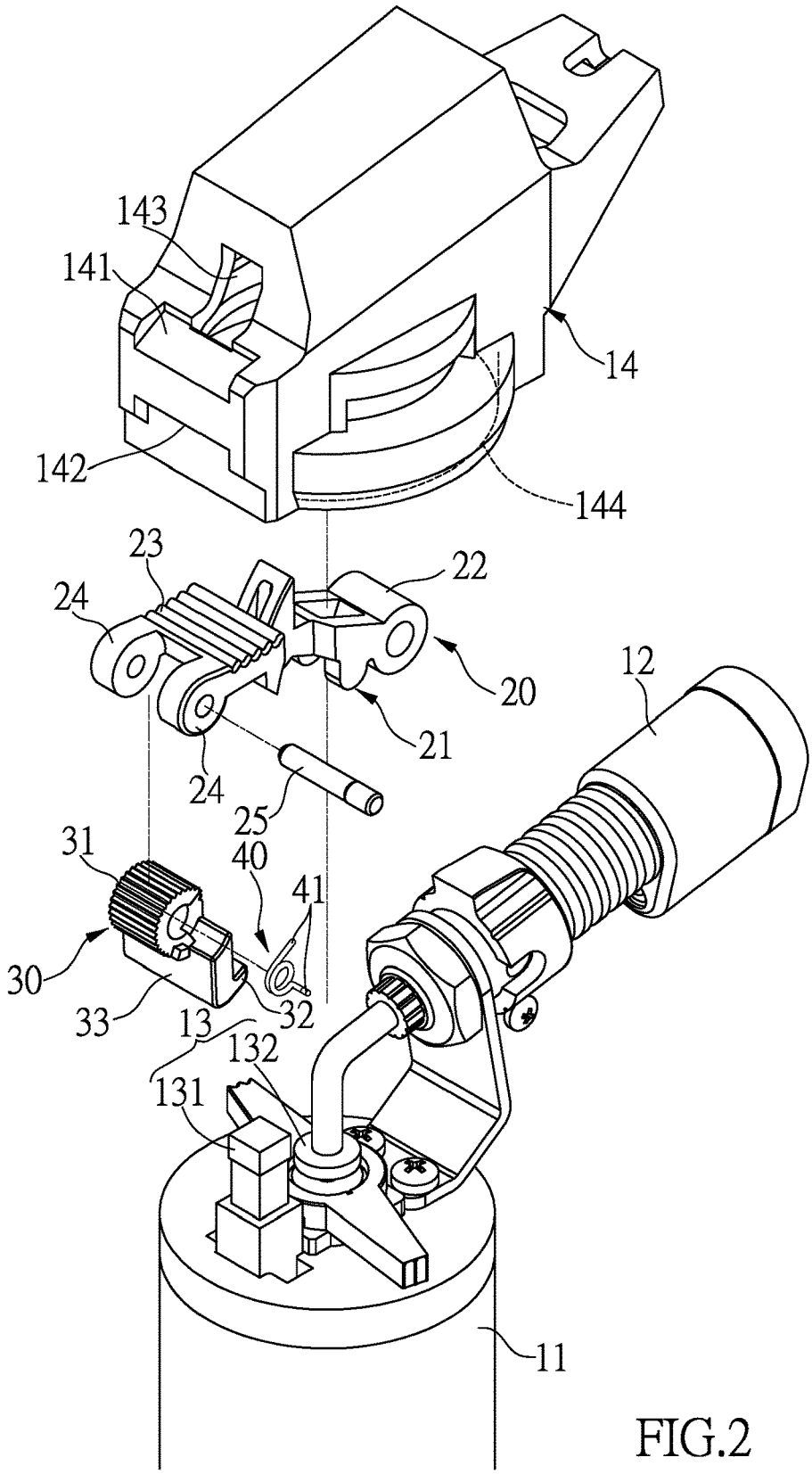
FIG. 2 is an exploded view of the safety device of the present invention.
Figure 3:
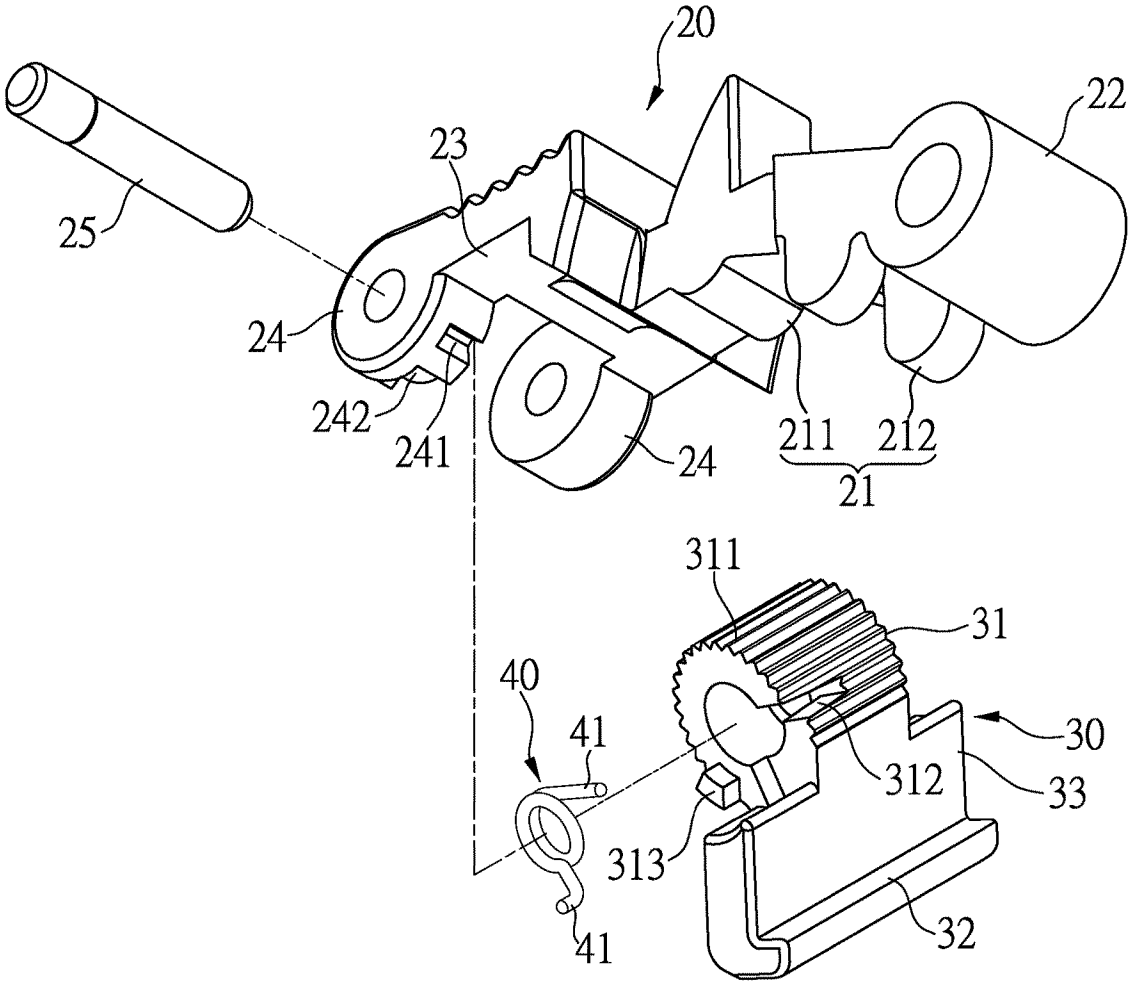
FIG. 3 shows the lever and the restriction member of the safety device of the present invention.

Referring to FIGS. 1 to 3, a gas burner 10 includes a gas tube 11 and a nozzle 12 connected to the gas tube 11. The safety device of the present invention comprises an ignition-gas unit 13 connected to the nozzle 12. A cover 14 is mounted to the ignition-gas unit 13 and includes a stop 141 on the outside thereof, a hole 143 and an installation port 144. The installation port 144 faces downward. The hole 143 is located beside the stop 141 and communicates with the installation port 144. A restriction slot 142 is located beside the stop 141. The ignition-gas unit 13 is accommodated in the installation port 144. A lever 20 includes a pivotal portion 22, a free end 23 and a touch portion 21 which is located between the pivotal portion 22 and the free end 23. The touch portion 21 is located corresponding to the ignition-gas unit 13. The pivotal portion 22 is pivotably connected to the installation port 144, and the free end 23 extends beyond the hole 143.

A restriction member 30 includes an activation portion 31 and a hook portion 32 respectively located on two ends thereof. The activation portion 31 is pivotably connected to the free end 23 of the lever 20. The hook portion 32 faces the stop 141. Specifically, the free end 23 of the lever 20 includes two lugs 24 and a pivot 25. The two lugs 24 extend from the activation portion 31. Each of the two lugs 24 and the activation portion 31 includes a passage through which the pivot 25 extends. The activation portion 31 includes a toothed portion 311 defined in the outside thereof so as to increase friction when the users operates the activation portion 31. One of the two lugs 24 of the lever 20 has a recess 242. The activation portion 31 has a protrusion 313 which is movably located within the recess 242 to restrict pivotal movement of the activation portion 31. The other one of the two lugs 24 has a first slot 241. The activation portion 31 has a second slot 312. A spring 40 is located between the free end 23 of the lever 20 and the activation member 31 of the restriction member 30. Specifically, the spring 40 is a torsion spring and includes two distal ends 41. The two distal ends 41 are respectively engaged with the first and second slots 241, 312 so as to provide a force to drive the restriction member 30 relative to the lever 20. A board 33 is located between the activation portion 31 and the hook portion 32. An angle less than 90 degrees is formed between the board 33 and the hook portion 32.

Figure 4:
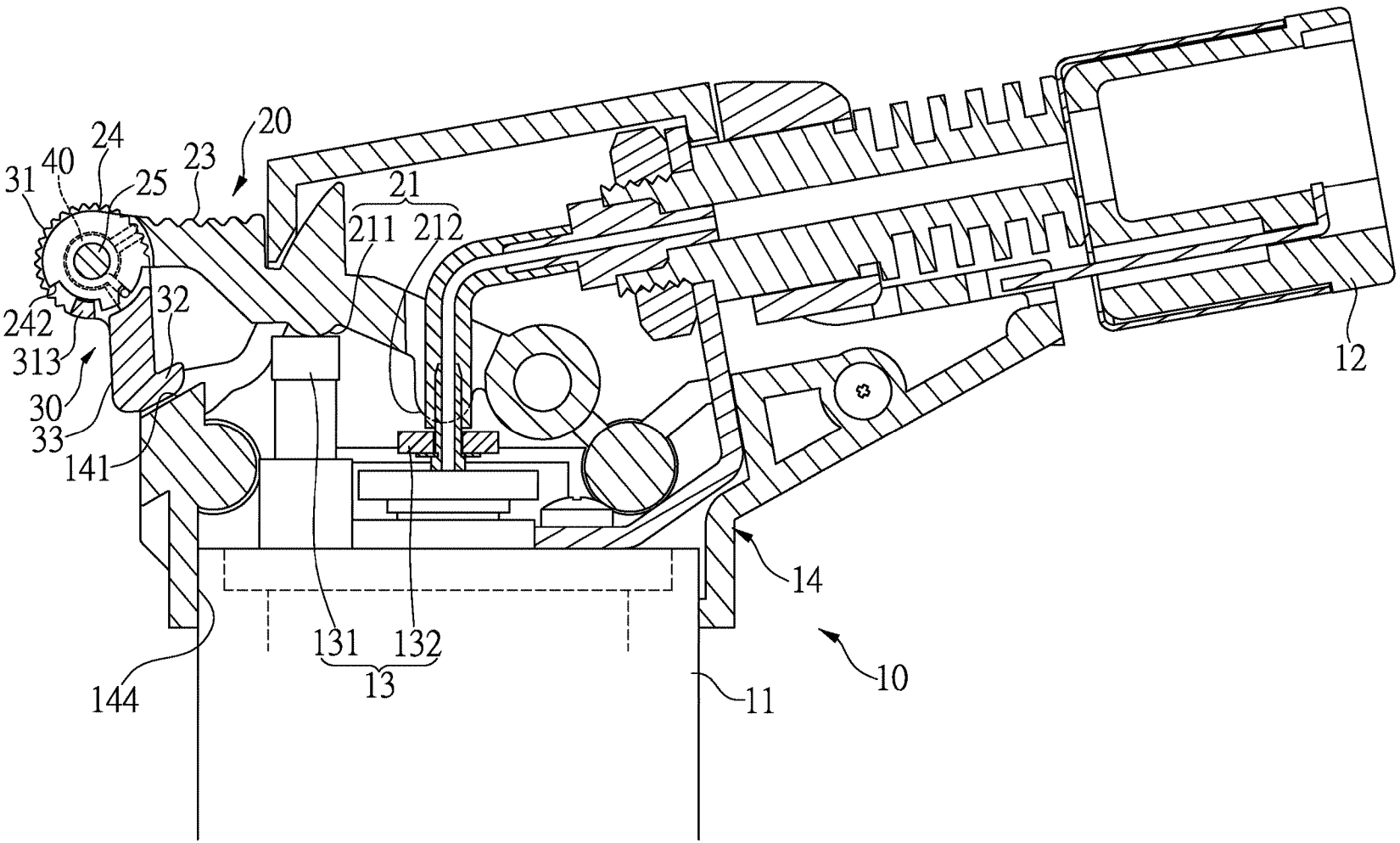
FIG. 4 is a cross sectional view, taken along line Iv-Iv in FIG. 1.
Figure 5:
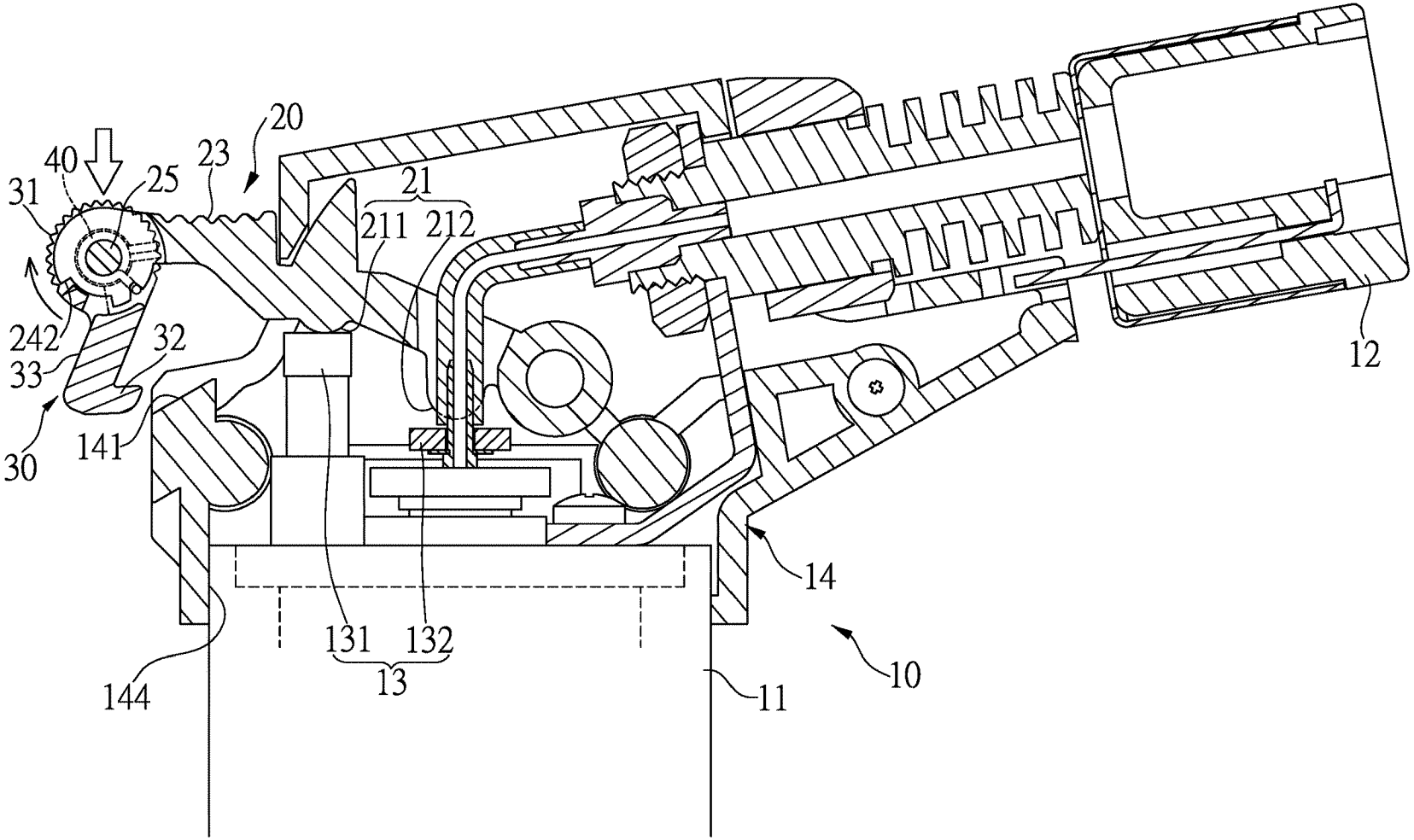
FIG. 5 shows the action to ignite the gas burner.
Figure 6:
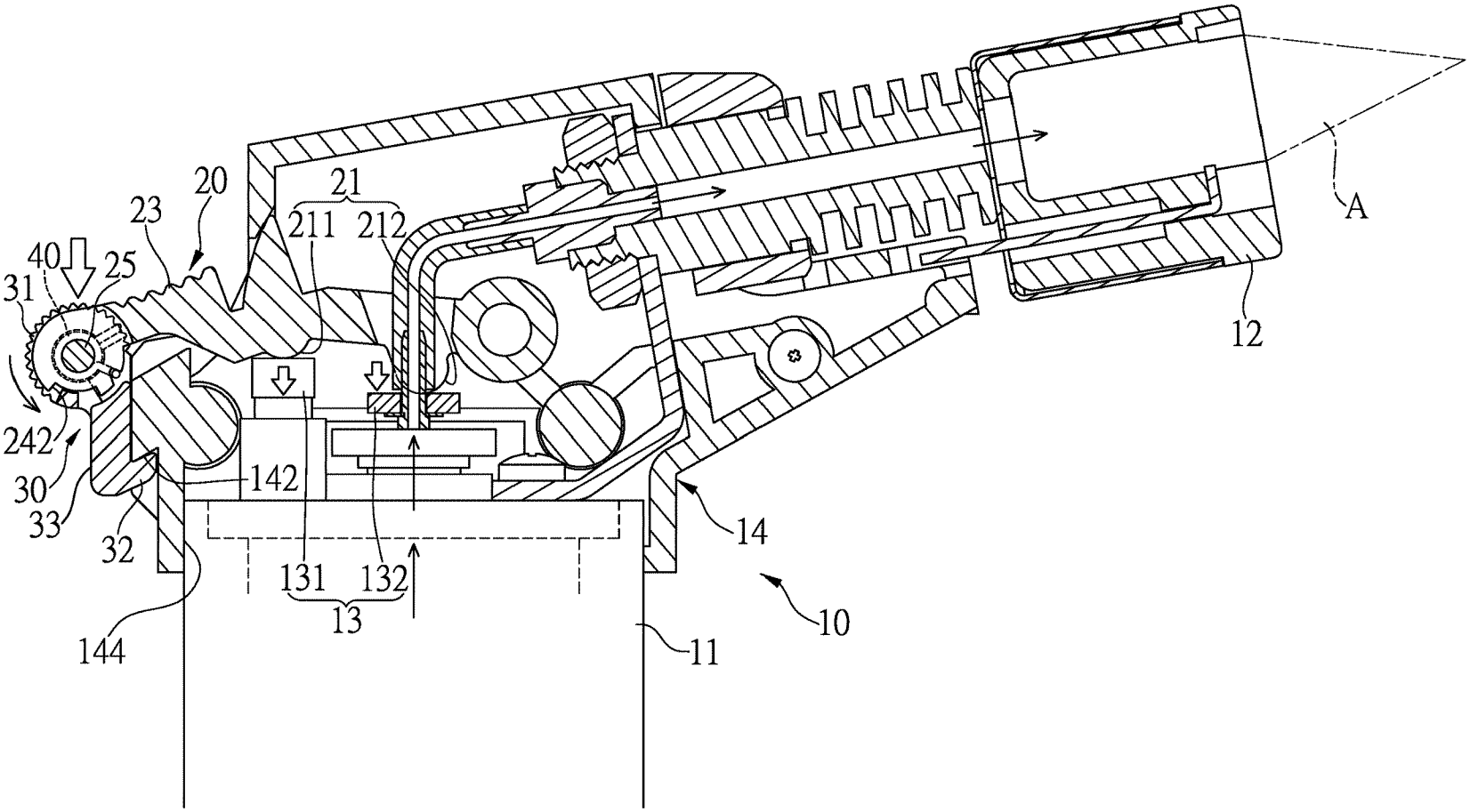
FIG. 6 shows that the hook portion of the restriction member hooks to the restriction slot to fix the position of the restriction member.

As shown in FIG. 4, the spring 40 normally maintains the restriction member 30 to let the hook portion 32 contact the stop 141 so as to restrict the free end 23 from being pushed downward to ignite the gas burner 10. On the other hand, as shown in FIGS. 5 and 6, when the restriction member 30 drives the spring 40 to move the hook portion 32 away from the free end 23 of the lever 20, the free end 23 is able to be pushed downward and the touch portion 21 presses the ignition-gas unit 13. Specifically, the ignition-gas unit 13 includes an ignition button 131 and a gas button 132, and the touch portion 21 includes an ignition press portion 211 and a gas press portion 212. As shown in FIG. 6, when the touch portion 21 is pushed downwardly, the ignition press portion 211 and the gas press portion 212 respectively press the ignition button 131 and the gas button 132. The gas ejects toward the nozzle 12, and the gas is ignited by sparks at the nozzle 12 so as to form flames "A". The ignition of the gas burner 10 is completed by one-time action. The sparks at the nozzle 12 is made by the ignition-gas unit 13. When the free end 23 is pushed downward and the touch portion 21 presses the ignition-gas unit 13 to ignite the gas burner 10, the activation portion 31 is rotated to hook the hook portion 32 with the restriction slot 142. Therefore, the gas can be supplied continuously.

Figure 7:
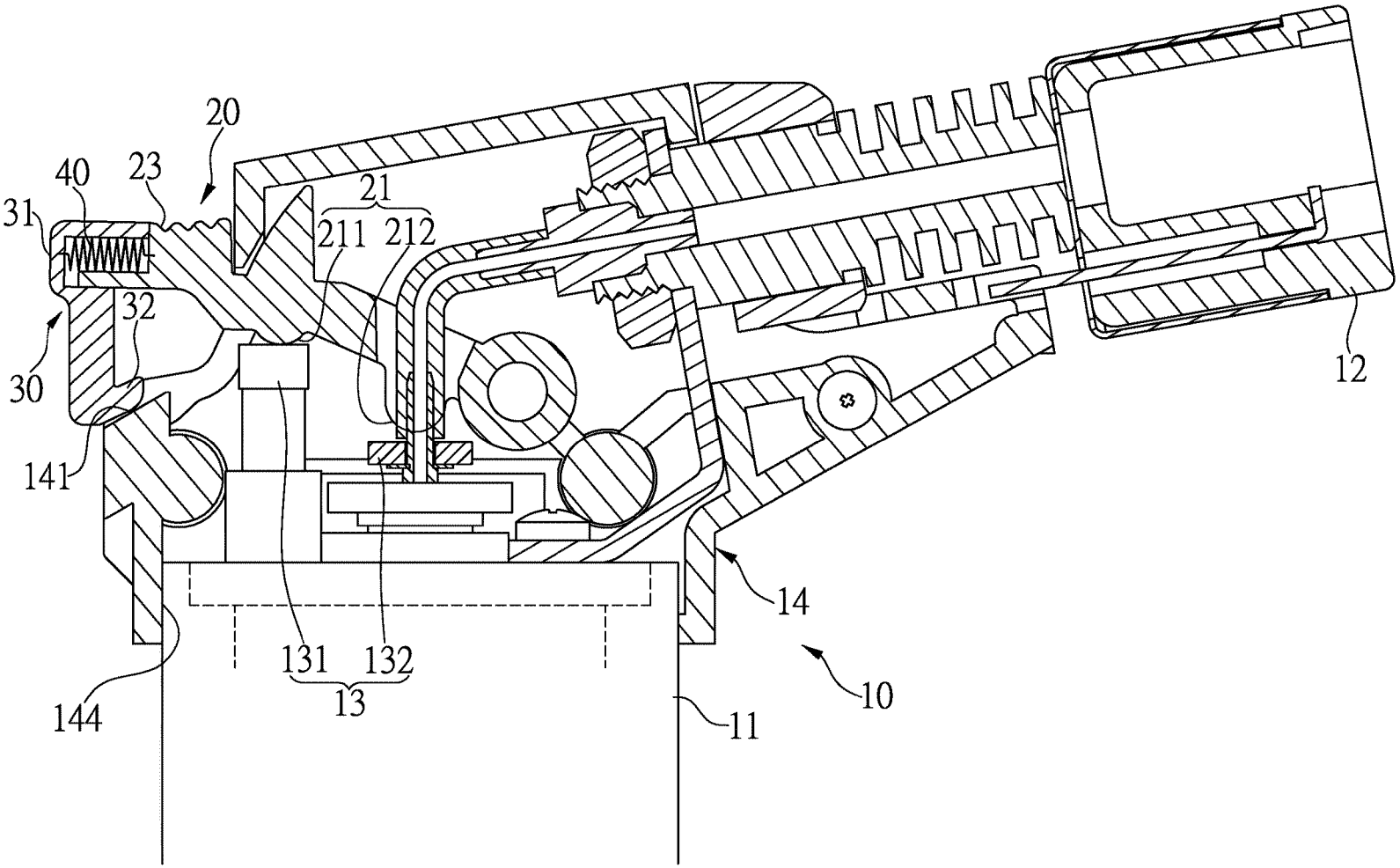
FIG. 7 shows that the spring drives the restriction member.
Figure 8:
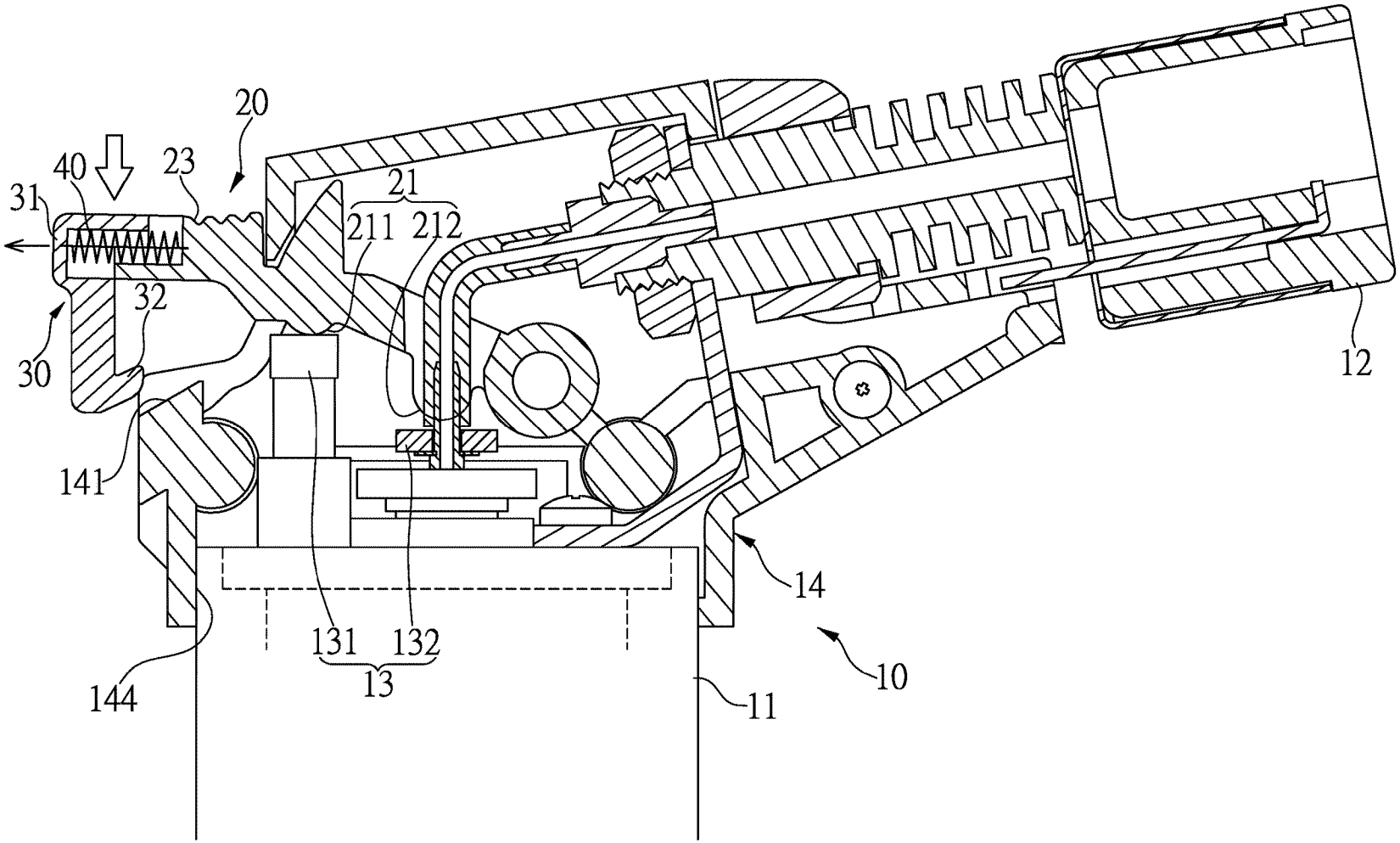
FIG. 8 shows that the restriction member pulls the spring.
Figure 9:
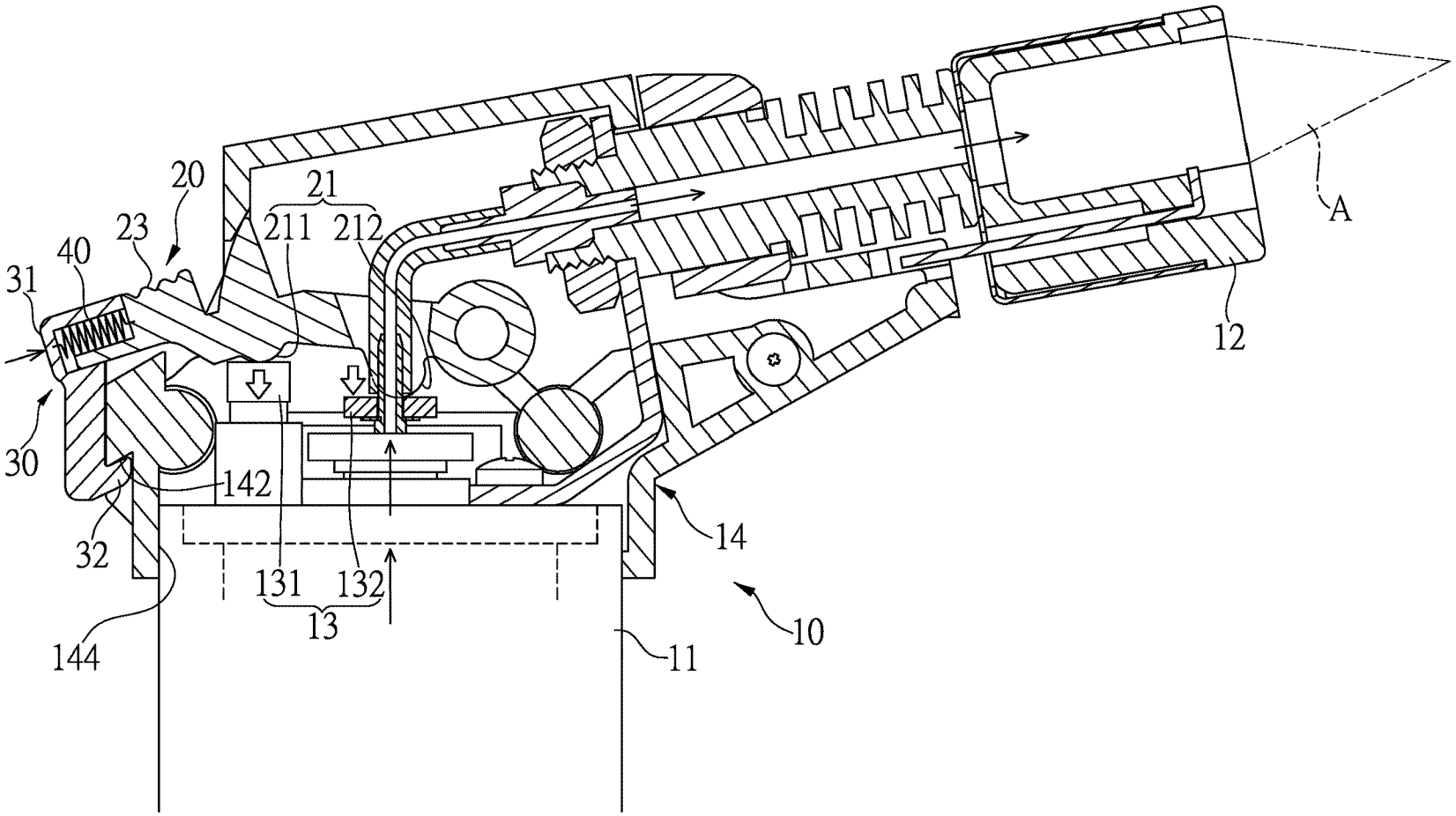
FIG. 9 shows that the restriction member is fixed at the ignition position.

As shown in FIGS. 7 to 9, the spring 40 is a compression spring, and two ends of the spring 40 are respectively connected to the free end 23 of the lever 20 and the activation portion 31 of the restriction member 30. The spring 40 normally pulls the restriction member 30 toward the cover 14 and the hook portion 32 contacts the stop 141, so that the free end 23 of the lever 20 cannot be pushed downward. When the activation portion 31 of the restriction member 30 is pulled to extend spring 40 in the direction away from the free end 23 linearly, the hook portion 32 is disengaged from the stop 141, so that the free end 23 of the lever 20 is able to be pushed downward, and the touch portion 21 pushes the ignition-gas unit 13 to ignite the gas burner 10.

The advantages of the present invention are that the restriction member 30 and the spring 40 are all connected to the free end 23 of the lever 20 so as to simplify the structure of the safety device. The spring 40 normally maintains the hook portion 32 to contact the stop 141 of the cover 14 to safely prevent unexpectedly ignition action from being happened.

When igniting the gas burner 10, the hook portion 32 is moved away from the stop 141, and the free end 23 can be simultaneously pushed downward to complete the ignition action.

The hook portion 32 hooks the restriction slot 142 to maintain the lever 20 at the ignition position so that the user's finger does not need to keep on pressing the lever 20 while the gas is continuously supplied and ignited.

While we have shown and described the embodiment in accordance with the present invention, it should be clear to those skilled in the art that further embodiments may be made without departing from the scope of the present invention.

What is claimed is:

1. A safety device for a gas burner which includes a gas tube and a nozzle connected to the gas tube, the safety device comprising:

an ignition-gas unit adapted to the nozzle, a cover mounted to the ignition-gas unit, the cover having a stop on an outside thereof, a hole and an installation port which faces downward, the hole located beside the stop and communicating with the installation port, the cover including a restriction slot located beside the stop, the ignition-gas unit being accommodated in the installation port;

a lever having a pivotal portion, a free end and a touch portion located between the pivotal portion and the free end, the touch portion located corresponding to the ignition-gas unit, the pivotal portion pivotably connected to the installation port, the free end extending beyond the hole;

a restriction member having an activation portion and a hook portion respectively located on two ends thereof, the activation portion located at the free end of the lever, the hook portion facing the stop, and a spring located between the free end of the lever and the activation member of the restriction member so as to provide a force to allow the restriction member to move relative to the free end of the lever, the spring maintaining the restriction member to contact the hook portion against the stop so as to restrict the free end from being pressed downward, when the restriction member drives the spring to move the hook portion away from the free end of the lever, and the free end is pushed downward and the touch portion presses the ignition-gas unit, the activation portion is rotated to hook the hook portion with the restriction slot.

2. The safety device as claimed in claim 1, wherein the free end of the lever includes two lugs and a pivot, the two lugs extend from the activation portion, the pivot extends through the two lugs and the activation portion.

3. The safety device as claimed in claim 2, wherein each of the two lugs and the activation portion includes a passage through which the pivot extends, the activation portion includes a toothed portion defined in an outside thereof.

4. The safety device as claimed in claim 3, wherein one of the two lugs of the lever has a recess, the activation portion has a protrusion which is movably located within the recess to restrict pivotal movement of the activation portion.

5. The safety device as claimed in claim 2, wherein the other one of the two lugs has a first slot, the activation portion has a second slot, the spring is a torsion spring which includes two distal ends which are respectively engaged with the first and second slots so as to drive the restriction member relative to the lever.

6. The safety device as claimed in claim 5, wherein a board is located between the activation portion and the hook portion, an angle less than 90 degrees is formed between the board and the hook portion.

7. The safety device as claimed in claim 1, wherein the spring is a compression spring, two ends of the spring are respectively connected to the free end of the lever and the activation portion of the restriction member, the spring normally pulls the restriction member toward the cover and the hook portion contacts the stop, so that the free end of the lever cannot be pushed downward, when the restriction member pulls the spring in a direction away from the free end linearly, the hook portion is disengaged from the stop, so that the free end of the lever is able to be pushed downward, and the touch portion pushes the ignition-gas unit.

* * * * *